US009689288B2

(12) United States Patent
Zahdeh

(10) Patent No.: US 9,689,288 B2
(45) **Date of Patent: *Jun. 27, 2017**

(54) OIL PAN AND ENGINE ASSEMBLY INCLUDING THE OIL PAN

(71) Applicant: GM GLOBAL TECHNOLOGY OPERATIONS LLC, Detroit, MI (US)

(72) Inventor: Akram R. Zahdeh, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/814,550

(22) Filed: Jul. 31, 2015

(65) Prior Publication Data

US 2016/0245134 A1 Aug. 25, 2016

Related U.S. Application Data

(60) Provisional application No. 62/120,047, filed on Feb. 24, 2015.

(51) Int. Cl.
*F01M 11/00* (2006.01)

(52) U.S. Cl.
CPC . *F01M 11/0004* (2013.01); *F01M 2011/0025* (2013.01); *F01M 2011/0045* (2013.01)

(58) Field of Classification Search
CPC ..... F01M 11/0004; F01M 2011/0025; F01M 2011/0045; F01M 5/021; F01M 2005/023; F01M 2011/033; F01M 2011/0037
USPC ..... 123/195 C
See application file for complete search history.

(56) References Cited

U.S. PATENT DOCUMENTS 2,134,778 A * 11/1938 Clarke ..... F16N 39/00 123/196 AB
3,232,283 A * 2/1966 Toland ..... F01P 11/08 123/41.33
4,134,380 A * 1/1979 Niwa ..... F01M 5/005 123/142.5 E
4,258,679 A * 3/1981 Leitermann ..... F01M 5/007 123/196 AB
4,519,348 A * 5/1985 Hamilton ..... F01M 11/0004 123/195 C
5,301,642 A * 4/1994 Matsushiro ..... F01M 5/001 123/142.5 R (Continued)

FOREIGN PATENT DOCUMENTS

JP 5176789 B2 * 4/2013 ..... F01M 11/0004

*Primary Examiner* — Carlos A Rivera
*Assistant Examiner* — Anthony Taylor, Jr.
(74) *Attorney, Agent, or Firm* — Quinn IP Law

(57) ABSTRACT

An engine assembly includes an oil pan including an oil pan body defining a cavity. The oil pan body includes a dividing wall separating the cavity into a first compartment and a second compartment. The engine assembly further includes a drip tray coupled to the oil pan body. The drip tray is disposed over the second compartment and can direct oil to the first compartment where the oil is warmed up initially in order to minimize the time it takes to heat the oil when the internal combustion engine is warming up. The engine assembly further includes an oil scraper coupled to the oil pan body. The oil scraper is disposed over the drip tray and can scrape oil from a crankshaft.

16 Claims, 2 Drawing Sheets

(56) References Cited

U.S. PATENT DOCUMENTS

| | | | | |
|---|---|---|---|---|
| 6,058,898 | A * | 5/2000 | Freese | F01M 11/0004 123/195 C |
| 6,568,509 | B1 * | 5/2003 | Sugiura | F01M 11/0004 184/106 |
| 6,729,292 | B1 * | 5/2004 | Bock | F01M 11/0004 123/195 C |
| 7,516,728 | B1 * | 4/2009 | Staley | F01M 11/0004 123/195 C |
| 7,946,388 | B2 * | 5/2011 | Kobayashi | F01M 5/02 184/1.5 |
| 8,066,100 | B2 * | 11/2011 | Mori | F01M 11/0004 123/195 C |
| 8,402,929 | B2 * | 3/2013 | Marsh | F01P 1/06 123/196 A |
| 8,651,078 | B2 * | 2/2014 | Fasold | F01M 11/0004 123/196 A |
| 2004/0079318 | A1 * | 4/2004 | Batzill | F01M 11/0004 123/195 C |
| 2009/0026015 | A1 * | 1/2009 | Liimatta | F01M 11/0004 184/6.5 |
| 2010/0037850 | A1 * | 2/2010 | Jessberger | F01M 5/002 123/198 E |

* cited by examiner

OIL PAN AND ENGINE ASSEMBLY INCLUDING THE OIL PAN

CROSS-REFERENCE TO RELATED APPLICATIONS

This application claims the benefit of U.S. Provisional Application No. 62/120,047, filed Feb. 24, 2015, which is hereby incorporated by reference in its entirety.

TECHNICAL FIELD

The present disclosure relates to an oil pan and an engine assembly including the oil pan.

BACKGROUND

An oil pan can collect oil used to lubricate an internal combustion engine. During operation of the internal combustion engine, oil may circulate within the internal combustion engine to lubricate moving components of the internal combustion engine, dissipate thermal energy, and protect against wear of the internal combustion engine. After lubricating the moving parts of the engine, the oil is collected by the oil pan.

SUMMARY

To maximize fuel efficiency when an internal combustion engine is warming up, the oil in the oil pan should be heated to an optimum temperature as quickly as possible. When the oil is at its optimum temperature, fuel dilution in the oil can be minimized. In addition, the moisture in the oil can be minimized by maintaining the oil temperature at its optimum level, thereby maximizing the engine oil life. Accordingly, the presently disclosed engine assembly includes an oil pan capable of minimizing the time it takes to heat the oil when the internal combustion engine is warming up. In an embodiment, an engine assembly includes an oil pan including an oil pan body defining a cavity. The oil pan body includes a dividing wall separating the cavity into a first compartment and a second compartment. The engine assembly further includes a drip tray coupled to the oil pan body. The drip tray is disposed over the second compartment and can direct oil to the first compartment where the oil is warmed up initially in order to minimize the time it takes to heat the oil when the internal combustion engine is warming up. The drip tray can also serve as a windage tray to minimize hydrodynamic friction in the oil pan. The engine assembly further includes an oil scraper coupled to the oil pan body. The oil scraper is disposed over the drip tray and can scrape oil from a crankshaft. The present disclosure also relates to a vehicle including the engine assembly described above.

The above features and advantages and other features and advantages of the present teachings are readily apparent from the following detailed description of the best modes for carrying out the teachings when taken in connection with the accompanying drawings.

DETAILED DESCRIPTION

Figure 1:
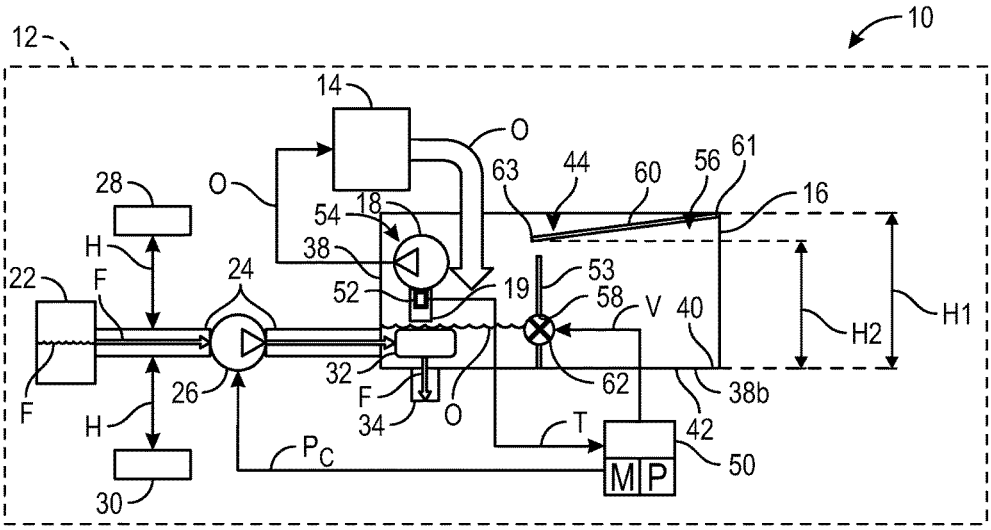
FIG. 1 is a schematic illustration of a vehicle including an engine assembly in accordance with an embodiment of the present disclosure, wherein the engine assembly includes an oil pan.

Referring to the drawings, wherein like reference numbers correspond to like or similar components throughout the several figures, referring to FIGS. 1-7, a vehicle 10, such as a car, includes an engine assembly 12. The engine assembly 12 includes an internal combustion engine 14 configured to propel the vehicle 10. The internal combustion engine 14 employs oil O for lubrication, among other things. The engine assembly 12 further includes an oil pan 16 coupled to the internal combustion engine 14. As a consequence, oil O can flow between the internal combustion engine 14 and the oil pan 16. Specifically, the oil O used to lubricate the internal combustion engine 14 can flow to the oil pan 16. The oil pan 16 then collects the oil O. The engine assembly 12 further includes an oil pump 18 coupled to the oil pan 16. Consequently, the oil pump 18 can move the oil O from the oil pan 16 back to the internal combustion engine 14 as well as to other vehicle components. The oil pump 18 includes a pump pickup conduit 19, such as a channel, or a pipe, configured to receive the oil O in the cavity 44. The pump pickup conduit 19 is in fluid communication with the cavity 44 in order to allow oil O to flow from the cavity 44 into the oil pump 18. The oil pump 18 is at least partially disposed inside the cavity 44.

To maximize fuel efficiency when the internal combustion engine 14 is warming up, the oil O in the oil pan 16 should be heated to an optimum temperature as quickly as possible. When the oil O is at its optimum temperature, fuel dilution in the oil can be minimized. Additionally, the moisture in the oil O can be minimized by maintaining the oil temperature at its optimum level, thereby maximizing the engine oil life. The oil pan 16 of the engine assembly 12 can minimize the time it takes to heat the oil O when the internal combustion engine 14 is warming up as discussed below.

The oil pan 16 is configured to hold the oil O and includes an oil pan body 36 having a plurality of walls 38. For example, in the depicted embodiment, the oil pan body 36 includes at least one sidewall 38*a* defining the perimeter of the oil pan 16 and at least one bottom wall 38*b* coupled to the sidewalls 38*a*. The sidewalls 38*a* include a top wall portion 38*c*. The oil pan body 36 defines an inner pan surface 40 and an outer pan surface 42 opposite the inner pan surface 40. The inner pan surface 40 defines an open cavity 44 configured, shaped, and sized to collect and hold the oil O. The oil pan body 36 may be wholly or partly made of a metallic material, such as a casted metal (e.g., cast iron) in order to enhance the structural integrity of the oil pan 16.

The oil pan 16 includes a dividing wall 53 coupled to at least one of the walls 38. For example, the dividing wall 53 can be coupled to the sidewall 38*a* and/or the bottom wall 38*b*. Regardless, the dividing wall 53 divides the cavity 44 into a first compartment 54 and a second compartment 56. The second compartment 56 is larger than the first compartment 54. In other words, the first compartment 54 has a volume (i.e., the first volume) that is less than the volume (i.e., the second volume) of the second compartment 56 in order to minimize the time it takes to warm up the oil O in the oil pan 16, because the oil O is first heated or cooled in the first compartment 54 as discussed in detail below. As a non-limiting example, the volume of the first compartment 54 may range between ¼ to ⅕ of the total volume of the cavity 44, whereas the volume of the second compartment 56 may range between ¾ and ⅘ of the total volume of the cavity 44. These volume ranges ensure that the oil O in the first compartment 54 is heated (or cooled) as quickly as possible, because the first compartment 54, which is the smaller compartment, is used to warm up the oil O. Warming up the oil O first in the first compartment 54 helps reduce friction in the internal combustion engine 14. Accordingly, the oil O should initially be directed to the first compartment 54. Consequently, the oil pump 18 can be disposed inside the first compartment 54. The first compartment 54 has a length (i.e., the first length L1), and the second compartment 56 has a second length L2. The second length L2 is greater than the first length L1.

The oil pan 16 further includes a drip tray 60 to direct the oil O stemming from other vehicle components, such as the internal combustion engine 14, into the first compartment 54. It is useful to direct all oil O from other vehicle components, such as the internal combustion engine 14, crankshaft 90 (FIG. 5), bearings, oil squirters, into the first compartment 54 in order to minimize the time it takes to warm up the oil O when the internal combustion engine 14 is starting. The drip tray 60 is coupled to the oil pan body 36 (e.g., the sidewall 38*a*) and is at least partly disposed within the cavity 44. Moreover, the drip tray 60 is obliquely angled relative to the sidewall 38*a* and the dividing wall 53 in order to direct the oil O into the first compartment 54.

The drip tray 60 is disposed over the entire length L1 of the second compartment 56, over the dividing wall 53, and over only a portion of the length L2 of the first compartment 54, thereby allowing the oil O to be directed to the first compartment 54. Specifically, the drip tray 60 has a first tray end 61 coupled to the sidewall 38*a* of the oil pan body 36 and a second tray end 63 disposed over the first compartment 54. The oil pan 16 defines a height (i.e., the first height H1) from the outer pan surface 42 to the first tray end 61, and another height (i.e., the second height H2) from the outer pan surface 42 to the second tray end 63. The first height H1 is greater than second height H2 so that the drip tray 60 is inclined toward the first compartment 54 in order to direct the oil O toward the first compartment 54.

The oil pan 16 further includes an oil scraper 80 coupled to the oil pan body 36 and the drip tray 60. Fasteners 74, such as bolts, can couple the oil scraper 80 to the drip tray 60 and the oil pan body 36. The oil scraper 80 can scrape oil O from the crankshaft 90 as the crankshaft rotates (in a rotational direction R). Accordingly, the oil scraper 80 can separate the oil O from the air around the crankshaft 90. In the depicted embodiment, the oil scraper 80 is disposed over the entirety of the drip tray 60. Moreover, the oil scraper 80 can be disposed over the dividing wall 53 and over only a portion of the first compartment 54. However, the oil scraper 80 extends along the entire length L1 of the second compartment 56. In the depicted embodiment, the oil scraper 80 includes a main scraper sheet 82 and a plurality of scraping panels 84 coupled to the main scraper sheet 82. The scraping panels 84 are obliquely angled relative to the main scraper sheet 82. Further, the oil scraper 80 includes a plurality of diverting panels 86 coupled to the main scraper sheet 82. The diverting panels 86 are spaced apart from the scraping panels 84 so as to define a gap 88. While the crankshaft 90 rotates, the oil O can enter through the gap 88 between the diverting panels 86 and the scraping panels 84. As the oil O moves through the gap 88, it eventually hits the scraping panel 84 and falls down to first to the drip tray 60 and then to the first compartment 54 of the oil pan body 36.

The oil scraper 80 and the drip pan 60 allow the oil O from other vehicle components, such as the crankshaft 90, to always return first to the first compartment 54. Further, the oil scraper 80 and the drip pan 60 isolate the oil O from the windage created by the rotation of the crankshaft 90. Such isolation is especially advantageous during high speed maneuvers and when the internal combustion engine 14 is tilted, because such isolation maintains the appropriate oil levels in the oil pan 16. The oil scraper 80 and the drip pan 60 also minimize the hydrodynamic friction in the crankcase 90.

Figure 6:
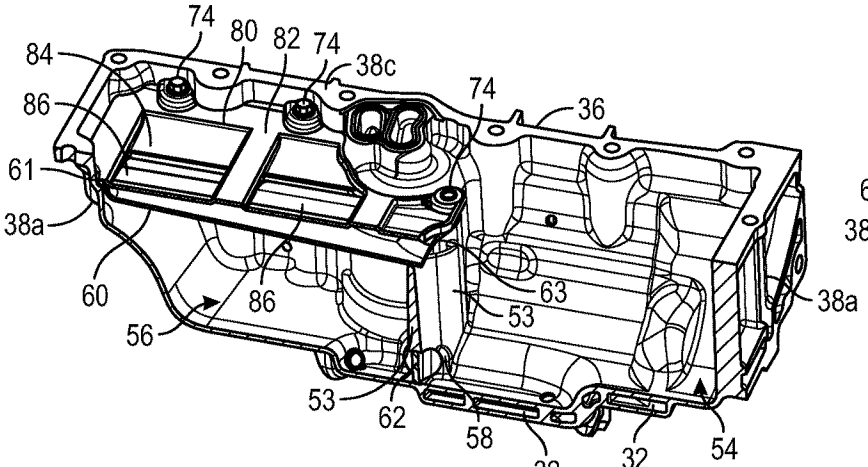
FIG. 6 is a schematic, sectional isometric view of the oil pan, showing a circular valve in a closed position.

The oil pan 16 has a compartment opening 58, such as a thru-hole, extending through the dividing wall 53, and the engine assembly 12 includes a valve 62 coupled to the dividing wall 53 in order to open or close the compartment opening 58. Thus, the valve 62 is at least partly disposed within the compartment opening 58 and may be any kind of valve suitable to block fluid flow (e.g., oil flow) between the first compartment 54 and the second compartment 56 via the compartment opening 58. Accordingly, the valve 62 can move between an open position (FIG. 7) and a closed position (FIG. 6). When the valve 62 is in the open position, the first compartment 54 is in fluid communication with the second compartment 56 through compartment opening 58 and, therefore, the oil O can flow between the first compartment 54 and the second compartment 56 via the compartment opening 58. In the closed position, the valve 62 blocks fluid flow between the first compartment 54 and the second compartment 56.

As discussed in detail below, the oil pan 16 has a pan passageway 32 (e.g., jacket) in fluid communication with an input passageway 24. Accordingly, heat transfer fluid F can flow between the input passageway 24 and the pan passageway 32. While flowing through the pan passageway 32, heat can be transferred between the oil O disposed in the oil pan 16 and the heat transfer fluid F flowing through the pan passageway 32 as discussed below. The engine assembly 12 also includes an output passageway 34 (e.g., conduit, tube, pipe, etc.) outside the oil pan 16. The output passageway 34 is in fluid communication with the pan passageway 32. Accordingly, the heat transfer fluid F can flow between the pan passageway 32 and the output passageway 34 once heat has been transferred between the heat transfer fluid F flowing through the pan passageway 32 and the oil O disposed in the oil pan 16. It is contemplated that the oil pan 16 may include one or more pan passageways 32.

The pan passageway 32 extends through at least one of the walls 38 and is entirely disposed between the inner pan surface 40 and the outer pan surface 42. In the depicted embodiment, the pan passageway 32 extends through at least the bottom wall 38*b*. It is envisioned, however, that the pan passageway 32 may also extend through the sidewalls 38*a*. Irrespective of its exact location, the pan passageway 32 is configured to carry the heat transfer fluid F in order to promote heat transfer between the oil O (FIG. 1) disposed in the open cavity 44 and the heat transfer fluid F flowing through the pan passageway 32.

The pan passageway 32 may have a substantially U-shape and has an inlet 46 in fluid communication with a fluid source 22 (FIG. 1) through the input passageway 24 (FIG. 1). Therefore, the heat transfer fluid F can flow between the fluid source 22 and the pan passageway 32. Further, the pan passageway 32 includes an outlet 48 in fluid communication with the output passageway 34. Thus, the heat transfer fluid F can flow from the pan passageway 32 to the output passageway 34 after the heat has been transferred between the oil O in the cavity 44 of the oil pan 16 and the heat transfer fluid F flowing through the pan passageway 32. Because the oil O in the oil pan 16 can be cooled by exchanging heat from the heat transfer fluid F, the engine assembly 12 does not need an oil cooler. Thus, the engine assembly 12 (and therefore the vehicle 10) does not have an oil cooler for cooling the oil O in the oil pan 16.

The engine assembly 12 further includes a heat transfer fluid source 22 capable of holding the heat transfer fluid F. The heat transfer fluid F can be any fluid (e.g., liquid) suitable for transferring heat. As a non-limiting example, the heat transfer fluid F may be a coolant, such as ethylene glycol. The fluid source 22 is in fluid communication with an input passageway 24 (e.g., conduit, tube, pipe, etc.). The input passageway 24 is outside the oil pan 16 and is fluidly coupled between the oil pan 16 and the fluid source 22. Accordingly, the heat transfer fluid F can flow from the fluid source 22 to the oil pan 16. A fluid transfer pump 26 is also coupled to the input passageway 24 in order to move the heat transfer fluid F from the fluid source 22 to the oil pan 16 through the input passageway 24.

The input passageway 24 is in thermal communication with a heat source 28. As a consequence, the heat source 28 can heat the heat transfer fluid F flowing through the input passageway 24. As non-limiting examples, the heat source 28 can be an exhaust manifold, an exhaust gas recirculation system, a turbocharger, an engine block, an engine head, or a combination thereof. Regardless of the kind of heat source 28 used, heat H can be transferred between the heat transfer fluid F flowing through the input passageway 24 and the heat source 28.

The input passageway 24 is in thermal communication with a cooling source 30. As a consequence, the cooling source 30 can cool the heat transfer fluid F flowing through the input passageway 24. As a non-limiting example, the cooling source 30 can be the cooling system of the vehicle 10. Irrespective of the kind of cooling source 30 used, heat H can be transferred between the heat transfer fluid F flowing through the input passageway 24 and the cooling source 30.

The pan passageway 32 is fluidly coupled to the inlet 46, such as a pipe, tube or any suitable conduit. The inlet 46 is in fluid communication with the fluid source 22 through the input passageway 24. Therefore, the heat transfer fluid F can flow between the fluid source 22 and the pan passageway 32. Further, the pan passageway 32 is fluidly coupled to the outlet 48, such as a pipe, tube or any suitable conduit. The outlet 48 is in fluid communication with the output passageway 34. Thus, the heat transfer fluid F can flow from the pan passageway 32 to the output passageway 34 after the heat has been transferred between the oil O in the first compartment 54 of the oil pan 16 and the heat transfer fluid F flowing through the pan passageway 32. Because the oil O in the oil pan 16 can be cooled by exchanging heat from the heat transfer fluid F, the engine assembly 12 does not need an oil cooler. Thus, the engine assembly 12 (and therefore the vehicle 10) does not have an oil cooler for cooling the oil O in the oil pan 16. However, the second compartment 56 may also include a pan passageway for cooling or heating the oil O.

The pan passageway 32 is in fluid communication with the input passageway 24. Accordingly, the heat transfer fluid F can flow between the input passageway 24 and the pan passageway 32. While flowing through the pan passageway 32, heat can be transferred between the oil O in the first compartment 54 and the heat transfer fluid F flowing through the pan passageway 32. The engine assembly 12 also includes an output passageway 34 (e.g., conduit, tube, pipe, etc.) outside the oil pan 16. The output passageway 34 is in fluid communication with the pan passageway 32. Accordingly, the heat transfer fluid F can flow between the pan passageway 32 and the output passageway 34 once heat has been transferred between the heat transfer fluid F flowing through the pan passageway 32 and the oil O disposed in the oil pan 16. It is contemplated that the oil pan 16 may include one or more pan passageways 32. Regardless of the quantity, the flowrate of the heat transfer fluid F flowing through the pan passageway 32 can be adjusted by varying the power output of the fluid transfer pump 26 (i.e., the pump power).

The engine assembly 12 further includes a controller 50 in communication (e.g., electronic communication) with the fluid transfer pump 26. Accordingly, the controller 50 may alternatively be referred to as a thermal control module and can command the fluid transfer pump 26 to adjust its power output (i.e., pump power). The controller 50 may include hardware elements such as a processor (P), memory (M), circuitry including but not limited to a timer, oscillator, analog-to-digital (A/D) circuitry, digital-to-analog (D/A) circuitry, a digital signal processor, and any necessary input/output (I/O) devices and other signal conditioning and/or buffer circuitry. The memory (M) may include tangible, non-transitory memory such as read only memory (ROM), e.g., magnetic, solid-state/flash, and/or optical memory, as well as sufficient amounts of random access memory (RAM), electrically-erasable programmable read-only memory (EEPROM), and the like. The controller 50 can send a signal (i.e., the power command signal Pc) to the fluid transfer pump 26 in order to increase or decrease its pump power. In other words, the controller 50 is programmed to adjust the pump power of the fluid transfer pump 26 in order to adjust the flowrate of the heat transfer fluid F flowing through the pan passageway 32.

Figure 2:
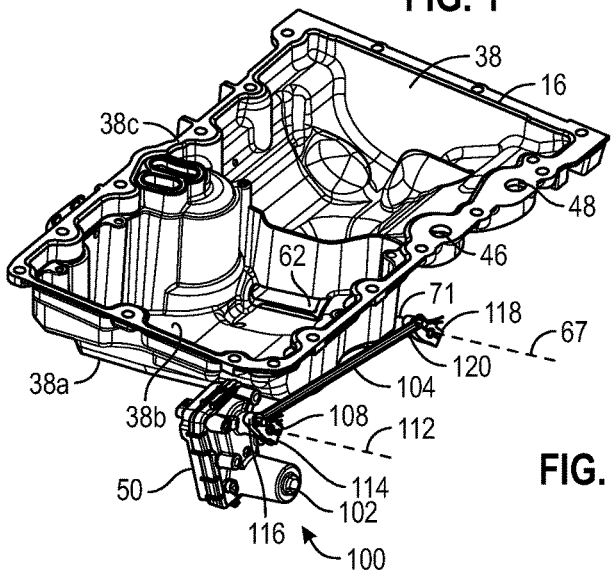
FIG. 2 is a schematic, perspective view of the oil pan shown in FIG. 1.
Figure 3:
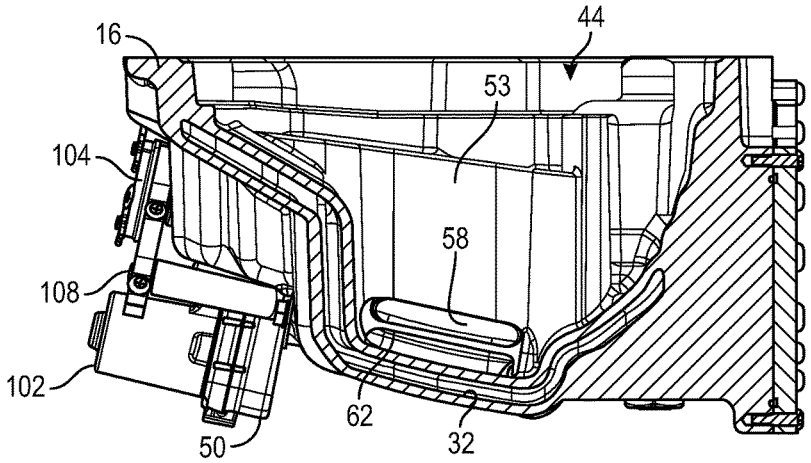
FIG. 3 is a schematic, sectional front view of the oil pan.
Figure 5:
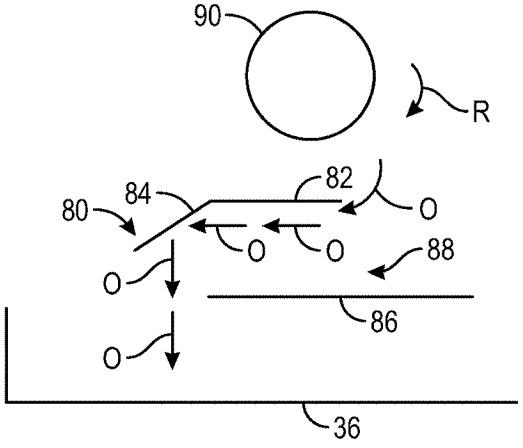
FIG. 5 is a schematic illustration of a crank shaft, and an oil scraper, and the oil pan.
Figure 4:
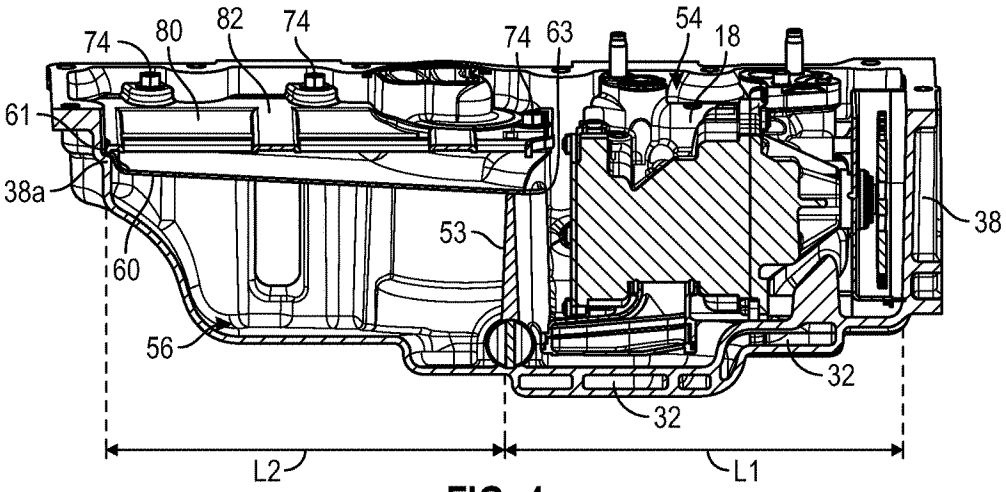
FIG. 4 is a schematic, sectional side view of the oil pan.
Figure 7:
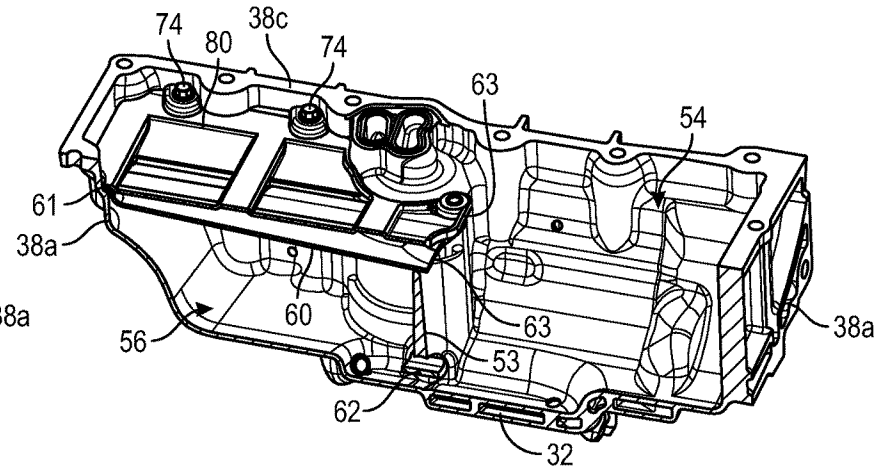
FIG. 7 is a schematic, sectional isometric view of the oil pan, showing the circular valve in an open position.

With reference to FIGS. 2 and 3, the engine assembly 12 includes a valve actuation assembly 100 coupled to the valve 62 and capable of moving the valve 62 between the open position and the closed position. Specifically, the valve actuation assembly 100 can be coupled to an outer valve portion 71 of the valve 62. The outer valve portion 71 is disposed outside the cavity 44. In the depicted embodiment, the valve actuation assembly 100 is disposed outside the cavity 44 and includes an actuator motor 102 (or any other suitable actuator) and a link 104 interconnecting the actuator motor 102 and the outer valve portion 71. The outer valve portion 71 and the valve actuation assembly 100 are positioned outside the oil pan body 36 in order to facilitate actuation of the valve 62.

The link 104 can be a bar, a rod, or any other suitable rigid elongated device capable of transferring force and moment. Accordingly, the link 104 is wholly or partly made of a rigid material, such as metal, in order to move the valve 62. The actuator motor 102 is operatively coupled to (and controlled by) the controller 50 and includes an output motor shaft 108 capable of rotating about a motor axis 112.

The valve actuation assembly 100 further includes a first coupling 114, such as a clamp, coupling the output motor shaft 108 to the link 104 at a location offset from the motor axis 112. Specifically, the first coupling 114 directly couples a first link end 116 of the link 104 to the output motor shaft 108. Therefore, the first link end 116 of the link 104 is offset from the motor axis 112 such that rotation of the output motor shaft 108 about the motor axis 112 causes the link 104 to translate relative to the oil pan body 36.

In addition to the first coupling 114, the valve actuator assembly 100 includes a second coupling 118, such as a clamp, connecting the outer valve portion 71 to the link 104 at a location offset from a valve axis 67. In particular, the second coupling 118 couples a second link end 120 of the link 104 to the outer valve portion 71. Thus, the second link end 120 (which is opposite the first link end 116) of the link 104 is offset from the valve axis 67 such that translation of the link 104 causes the outer valve portion 71 (and therefore the valve 62) to rotate about the valve axis 67.

The engine assembly 12 further includes a temperature sensor 52 in communication (e.g., electronic communication) with the controller 50. The temperature sensor 52 may be a thermocouple or any other sensor suitable for measuring the temperature of the oil O. In the depicted embodiment, the temperature sensor 52 is disposed inside the pump pickup conduit 19 and can therefore measure the temperature of the oil O pumped to the internal combustion engine 14. Because the temperature sensor 52 is located inside the pump pickup conduit 19, the temperature sensor 52 is isolated from oil fluctuation and windage of the oil pan 16 and can sense the temperature of the oil O regardless of whether the oil O pumped to the internal combustion engine 14 originates from the first compartment 54 or the second compartment 56. In the depicted embodiment, the temperature sensor 52 is located in the pump pickup conduit 19 of the oil pump 18 in order to obtain an accurate temperature measurement. The controller 50 is programmed to receive a signal (i.e., the temperature signal T) from the temperature sensor 52, which is indicative of the temperature of the oil O in the first compartment 54. Because the temperature sensor 52 is located inside the pump pickup conduit 19, the temperature readings from the temperature sensor 52 can be used to diagnose pump cavitation and malfunctioning.

The controller 50 is also in communication (e.g., electronic communication) with the valve 62. Accordingly, the controller 50 can control the movement of the valve 62. Specifically, the controller 50 is programmed to send a signal (i.e., valve signal V) to the actuator motor 102, thereby causing the valve 62 to move between the open position or the closed position. For example, the controller 50 can be programmed to command the valve 62 to move from the closed position to the open position when the temperature of the oil O in the first compartment 54 is greater than a predetermined temperature (i.e., the first predetermined temperature). Further, the controller 50 can be programmed to command the fluid transfer pump 26 to adjust (e.g., increase) its pump power in order to adjust (e.g., increase) the flowrate of the heat transfer fluid F when the temperature of the oil O in the first compartment 54 is greater than another predetermined temperature (i.e., the second predetermined temperature). The second predetermined temperature may be greater than the first predetermined temperature.

Before starting the internal combustion engine 14, the oil level may be above the height of the dividing wall 53. Thus, when the internal combustion engine 14 is off, the oil O can flow between the first compartment 54 and the second compartment 56 over the dividing wall 53. However, at this juncture, the valve 62 is in the closed position. Accordingly, the oil O cannot flow between the first compartment 54 and the second compartment 56 through the compartment opening 58. After the internal combustion engine 14 is started, the oil pump 18 moves some of the oil O out of the oil pan 16 and, therefore, the oil level decreases. At this point, the oil level does not reach the height of the dividing wall 53. Because at this point the valve 62 is still in the closed position, the oil O does not flow between the first compartment 54 and the second compartment 56 (either over the dividing wall 53 or through the compartment opening 58).

As the internal combustion engine 14 keeps running, the heat transfer fluid F is heated or cooled before being introduced into the pan passageway 32. To heat the heat transfer fluid F, heat can be transferred from the heat source 28 (e.g., exhaust manifold) to the heat transfer fluid F while the heat transfer fluid F is flowing through the input passageway 24 as discussed above. To cool the heat transfer fluid F, heat can be transferred from the heat transfer fluid F to the cooling source 30 while the heat transfer fluid F flows through the input passageway 24. The heated or cooled heat transfer fluid F is then introduced into the pan passageway 32 while the oil O is in the first compartment 54 of the oil pan 16. At this juncture, the heat transfer fluid F flows through the pan passageway 32 from the inlet 46 to the outlet 48. While the heat transfer fluid F flows through the pan passageway 32, heat is transferred between the oil O disposed in the first compartment 54 of the oil pan 16 and the heat transfer fluid F flowing through the pan passageway 32 in order to cool or warm up the oil O. Due to the heat transfer facilitated by the pan passageway 32, the temperature of the oil O in the first compartment 54 eventually reaches its optimum temperature (i.e., the first predetermined temperature). Once the temperature sensor 52 detects that the oil O in the first compartment 14 has reached the optimum temperature (i.e., the first predetermined temperature), the controller 50 receives a signal (i.e., the temperature signal T) from the temperature sensor 52. Upon receipt of this temperature signal T, the controller 50 commands the valve 62 to move from the closed position to the open position. In response, the valve 62 moves from the closed position to the open position, thereby allowing the oil O to flow between the first compartment 54 and the second compartment 56 through the compartment opening 58. If the temperature of the oil O exceeds an optimum temperature range, the flowrate of the heat transfer fluid F may be increased to cool the oil O in the oil pan 16. For example, if the temperature of the oil O exceeds a maximum threshold temperature (i.e., the second predetermined temperature) as measured by the temperature sensor 52, then the controller 50 can command the fluid transfer pump 26 to increase its pump power in order to increase the flowrate of the heat transfer fluid F flowing through the pan passageway 32. The increased flowrate of the heat transfer fluid F can help cool off the oil O in the oil pan 16 until the temperature of the oil O is less than the maximum threshold temperature (i.e., the second predetermined temperature).

During a wide open throttle operation of the vehicle 10, the controller 50 commands the valve 62 to move to the fully open position to fluidly couple the first compartment 54 and the second compartment 56 in order to ensure maximum engine cooling and engine durability. During other vehicle operation conditions, the controller 50 commands the valve 62 to open proportionally relative to the desired oil temperature in order to minimize oil dilution and maximize fuel economy.

While the best modes for carrying out the teachings have been described in detail, those familiar with the art to which this disclosure relates will recognize various alternative designs and embodiments for practicing the teachings within the scope of the appended claims.

The invention claimed is:

1. An engine assembly, comprising:

an oil pan including an oil pan body, wherein the oil pan body defines a cavity and includes a dividing wall separating the cavity into a first compartment and a second compartment, wherein the first compartment is smaller than the second compartment, and the dividing wall has a compartment opening extending therethrough;

a valve disposed in the compartment opening;

a valve actuation assembly coupled to the valve, the valve is movable relative to the dividing wall between an open position and a closed position, the valve actuation assembly is configured to move the valve between the open position and the closed position, the valve includes an outer valve portion disposed outside the cavity, the valve actuation assembly is coupled to the outer valve portion of the valve, and the valve actuation assembly is disposed outside the cavity; and a drip tray coupled to the oil pan body, wherein the drip tray is disposed over the second compartment so as to direct oil to the first compartment where the oil is heated initially in order to minimize time needed to heat the oil as a corresponding engine warms up.

2. The engine assembly of claim 1, wherein the drip tray is obliquely angled relative to the dividing wall, the oil pan defines an inner pan surface, the inner pan surface defines the cavity, the dividing wall divides the cavity, the cavity has a total volume, the first compartment has a first volume, the second compartment has a second volume, the first volume ranges between ¼ and ⅕ of the total volume of the cavity, and the second volume ranges between ¾ and ⅘ of the total volume of the cavity.

3. The engine assembly of claim 1, further comprising an input passageway disposed outside the oil pan body, wherein the engine assembly further includes a fluid source disposed outside the oil pan body, the fluid source is configured to hold a heat transfer fluid, the drip tray is disposed over the dividing wall, the oil pan defines an inner pan surface and an outer pan surface opposite the inner pan surface, the oil pan has a pan passageway in fluid communication with the input passageway, the pan passageway has a U-shape, the pan passageway is in fluid communication with the fluid source through the input passageway to allow the heat transfer fluid to flow from the fluid source to the pan passageway, and the pan passageway is entirely disposed between the inner pan surface and the outer pan surface.

4. The engine assembly of claim 3, further comprising an output passageway disposed outside the oil pan body, wherein the output passageway is in fluid communication with the pan passageway to allow the heat transfer fluid to flow from the pan passageway to the output passageway, and the drip tray extends along an entire length of the second compartment.

5. The engine assembly of claim 4, further comprising a cooling source in thermal communication with the input passageway, wherein the drip tray is disposed over only a portion of an entire length of the first compartment.

6. The engine assembly of claim 5, further comprising an oil scraper coupled to the oil pan body, wherein the oil scraper is disposed over the drip tray, and the engine assembly is characterized by the absence of an oil cooler for cooling the oil in the oil pan.

7. The engine assembly of claim 6, further comprising a fluid transfer pump coupled to the input passageway in order to move the heat transfer fluid from the fluid source to the pan passageway, wherein the engine assembly further includes a controller, the controller is in communication with the fluid transfer pump, the controller is programmed to adjust a pump power of the fluid transfer pump, and the oil scraper extends along an entirety of a length of the second compartment.

8. The engine assembly of claim 7, wherein the oil scraper extends along only a portion of an entire length of the first compartment, and the oil scraper includes a main scraper sheet, a plurality of scraping panels coupled to the main scraper sheet, and a plurality of diverting panels coupled to the main scraper sheet, each of the plurality of scraping panels is obliquely angled relative to the main scraper sheet, and each of the plurality of diverting panels is spaced apart from a corresponding one of the plurality of scraping panels so as to define a gap.

9. The engine assembly of claim 1, wherein the oil pan body includes at least one sidewall, the oil pan body includes at least one bottom wall, the at least one bottom wall is coupled to the at least one sidewall, and the dividing wall is coupled to the at least one sidewall and the at least one bottom wall.

10. An oil pan, comprising:

an oil pan body defining a cavity, wherein the oil pan body includes a dividing wall separating the cavity into a first compartment and a second compartment, wherein the first compartment is smaller than the second compartment, and the dividing wall has a compartment opening extending therethrough;

a valve disposed in the compartment opening;

a valve actuation assembly coupled to the valve, the valve is movable relative to the dividing wall between an open position and a closed position, the valve actuation assembly is configured to move the valve between the open position and the closed position, the valve includes an outer valve portion disposed outside the cavity, the valve actuation assembly is coupled to the outer valve portion of the valve, and the valve actuation assembly is disposed outside the cavity; and a drip tray coupled to the oil pan body, wherein the drip tray is disposed over the second compartment and is obliquely angled relative to the dividing wall; and an oil scraper coupled to the oil pan body, wherein the oil scraper is disposed over the drip tray.

11. The oil pan of claim 10, wherein the drip tray is disposed over the dividing wall, and the oil scraper includes a main scraper sheet, a plurality of scraping panels coupled to the main scraper sheet, and a plurality of diverting panels coupled to the main scraper sheet, each of the plurality of scraping panels is obliquely angled relative to the main scraper sheet, and each of the plurality of diverting panels is spaced apart from a corresponding one of the plurality of scraping panels so as to define a gap.

12. The oil pan of claim 10, wherein the drip tray extends along an entire length of the second compartment.

13. The oil pan of claim 12, wherein the drip tray is disposed over only a portion of an entire length of the first compartment.

14. The oil pan of claim 10, wherein the oil scraper extends along an entirety of a length of the second compartment.

15. The oil pan of claim 14, wherein the oil scraper extends along only a portion of an entire length of the first compartment.

16. An oil an including an oil pan body, wherein the oil pan body defines a cavity and includes a dividing wall separating the cavity into a first compartment and a second compartment, wherein the first compartment is smaller than the second compartment;

a drip tray coupled to the oil pan body, wherein the drip tray is disposed over the second compartment so as to direct oil to the first compartment where the oil is heated initially in order to minimize time needed to heat the oil as a corresponding engine warms up;

wherein the drip tray is obliquely angled relative to the dividing wall, the drip tray is disposed over the dividing wall, the oil pan defines an inner pan surface, the inner pan surface defines the cavity, the dividing wall divides the cavity, the cavity has a total volume, the first compartment has a first volume, the second compartment has a second volume, the first volume is less than the second volume, and the second volume ranges between ¾ and ⅘ of the total volume of the cavity, the engine assembly includes an input passageway disposed outside the oil pan body, the engine assembly includes a fluid source disposed outside the oil pan body, the fluid source is in fluid communication with the input passageway, the fluid source is configured to hold a heat transfer fluid, the oil pan body defines an inner pan surface, the oil pan body defines an outer pan surface opposite the inner pan surface, the oil pan has a pan passageway in fluid communication with the input passageway, the pan passageway is in fluid communication with the fluid source through the input passageway to allow the heat transfer fluid to flow from the fluid source to the pan passageway, and the pan passageway is entirely disposed between the inner pan surface and the outer pan surface, the engine assembly includes an output passageway disposed outside the oil pan body, the output passageway is in fluid communication with the pan passageway to allow the heat transfer fluid to flow from the pan passageway to the output passageway, the drip tray extends along an entire length of the second compartment, the engine assembly includes a cooling source in thermal communication with the input passageway, the drip tray is disposed only over a portion of an entire length of the first compartment, the engine assembly includes an oil scraper coupled to the oil pan body, the oil scraper is disposed over the drip tray, the engine assembly includes a fluid transfer pump coupled to the input passageway in order to move the heat transfer fluid from the fluid source to the pan passageway, the engine assembly includes a controller in communication with the fluid transfer pump, the controller is programmed to adjust a pump power of the fluid transfer pump, and the oil scraper extends along an entirety of a length of the second compartment, the oil scraper extends along only a portion of an entire length of the first compartment, and the oil scraper includes a main scraper sheet, a plurality of scraper panels coupled to the main scraper sheet, and a plurality of diverting panels coupled to the main scraper sheet, each of the plurality of scraping panels is obliquely angled relative to the main scraper sheet, each of the diverting panels is spaced apart from a corresponding one of the plurality of scraping panels as to define a gap, the dividing wall has a compartment opening extending therethrough, the oil pan body includes at least one sidewall and at least one bottom wall coupled to the at least one sidewall, and the dividing wall is coupled to the at least one sidewall and the at least one bottom wall, the engine assembly includes a valve disposed in the compartment opening and a valve actuation assembly coupled to the valve, the valve is movable relative to the dividing wall between an open position and a closed position, the valve actuation assembly is configured to move the valve between the open position and the closed position, the valve includes an outer valve portion of the valve, the valve actuation assembly is disposed outside the cavity, the valve actuation assembly includes an actuator motor, the valve actuation assembly includes a link interconnecting the actuator motor and the outer valve portion, the actuator motor includes an output motor shaft configured to rotate about a motor axis, the actuator motor is coupled to the controller, the link is a bar, the valve actuation assembly includes a first coupling connecting the output motor shaft to the link at a location offset from the motor axis, the link includes a first link end, the link includes a second link end opposite the first link end, the first coupling directly couples the first link end of the link to the output motor shaft, the first link end of the link is offset from the motor axis such that rotation of the output motor shaft about the motor axis causes the link to translate relative to the oil pan body, the valve actuator assembly includes a second coupling connecting the outer valve portion to the link at a location offset from a valve axis, the second coupling couples the second link end of the link to the outer valve portion, the second link end of the link is offset from the valve axis such that translation of the link causes the outer valve portion and the valve to rotate about the valve axis, the engine assembly includes a temperature sensor in communication with the controller, the engine assembly includes an oil pump coupled to the oil pan, the oil pump includes a pump pickup conduit configured to receive the oil in the cavity, the temperature sensor is disposed inside the pump pickup conduit of the oil pump, the controller is programmed to receive a temperature signal from the temperature sensor, the temperature signal is indicative of a temperature of the oil in the first compartment, the controller is in communication with the valve such that the controller is configured to control a movement of the valve, the controller is programmed to send a valve signal to the actuator motor to cause the valve to move between the open position and the closed position, the controller is programmed to command the valve to move from the closed position to the open position when the temperature of the oil in the first compartment is greater than a first predetermined temperature, the controller is programmed to command the fluid transfer pump to increase a pump power of the fluid transfer pump in order to increase a flowrate of the heat transfer fluid when the temperature of the oil in the first compartment is greater than a second predetermined temperature, and the second predetermined temperature is greater than the first predetermined temperature.

* * * * *